US005492521A

United States Patent [19]

Wilkinson et al.

[11] Patent Number: 5,492,521

[45] Date of Patent: Feb. 20, 1996

[54] UNIVERSAL TWISTER FOR MOUNTING ON THE FRAME OF A TREADMILL OR OTHER EXERCISE DEVICE

[75] Inventors: William T. Wilkinson, Sunset Dr., R.D. #1, Salem, N.J. 08079; John J. Nelson, Levitown, Pa.

[73] Assignee: William T. Wilkinson, Salem, N.J.

[21] Appl. No.: 413,899

[22] Filed: Mar. 30, 1995

Related U.S. Application Data

[63] Continuation-in-part of Ser. No. 183,741, Jan. 21, 1994, Pat. No. 5,407,408.

[51] Int. Cl.[6] ..... A63B 22/14

[52] U.S. Cl. ..... 482/147; 482/51; 482/54

[58] Field of Search ..... 482/147, 54, 51, 482/70, 71, 27, 29, 72, 73

[56] References Cited

U.S. PATENT DOCUMENTS

| | | | |
|---|---|---|---|
| 4,568,079 | 2/1986 | Stark | 482/147 |
| 4,723,774 | 2/1988 | Monforte | 482/72 |
| 5,078,389 | 1/1992 | Chen | 482/147 |
| 5,242,340 | 9/1993 | Jerome | 482/147 |
| 5,242,356 | 9/1993 | Grenfell | 482/147 |
| 5,284,461 | 2/1994 | Wilkinson et al. | 482/147 |
| 5,415,609 | 5/1995 | Yang | 482/147 |

*Primary Examiner*—Lynne A. Reichard
*Attorney, Agent, or Firm*—Connolly & Hutz

[57] ABSTRACT

A twister exercise device includes a support assembly having a support bar which would be mounted on the frame of a main exercise device, such as a treadmill frame. A hollow adjusting bar is exposed parallel to the support bar. A twister disc is rotatably mounted across the support bar and adjusting bar. A hook shaped locking member is telescoped into each end of the adjusting bar for being hooked over frames of various widths.

16 Claims, 2 Drawing Sheets

UNIVERSAL TWISTER FOR MOUNTING ON THE FRAME OF A TREADMILL OR OTHER EXERCISE DEVICE

CROSS-REFERENCE TO RELATED APPLICATION

This application is a continuation-in-part of application Ser. No. 08/183,741, filed Jan. 21, 1994, now U.S. Pat. No. 5,407,408.

BACKGROUND OF THE INVENTION

With the ever growing trend toward health consciousness there has been an increase in the number of different types of exercises and exercise devices on the market and in use. This has lead to various specialties in exercise devices for different intended purposes. One of the disadvantages is the need or desire for multiple types of exercise devices with the attendant storage problems. Another concern is to satisfy the desirability for having the individual exercise devices conveniently at hand.

One form of exercise device which has been particularly popular is the treadmill. Another form of popular device is a twister. It would be desirable if these two forms of devices could be combined. It would be particularly desirable if, for example, a twister could be provided which could be readily mounted on different types and sizes of treadmills so that a user already having a treadmill could purchase such a twister and be confident that the twister could be mounted on the treadmill.

SUMMARY OF THE INVENTION

An object of this invention is to provide a twister which can be readily mounted on various types of treadmills or other basic exercise devices.

A further object of this invention is to provide such a twister which could be mounted and detached in a quick and convenient manner.

In accordance with this invention a universal twister is provided which includes a support assembly comprising a support member which would extend transversely over a treadmill belt and rest on the treadmill frame. A twister disc is rotatably mounted to the assembly. The assembly further includes an adjusting member generally parallel to the support member which also extends over the treadmill belt. A locking member is mounted to each end of the adjusting member in a movable manner so that the distance between the two locking members can vary. The locking members are hooked over the frame of the treadmill. Because the distance of the locking members can vary the twister could be mounted to treadmills of various widths.

In a preferred practice of this invention, the locking members are in the form of C-shaped hooks which telescope into and out of the hollow adjusting member. Preferably, each locking member is provided with a friction pad at its free end for pressing against the underside of the frame of the treadmill for resisting any dismounting movement.

The twister further preferably includes feet under the support member to elevate one end of the twister disc so that the twister disc would be horizontal when mounted on an inclined treadmill.

A BRIEF DESCRIPTION OF THE DRAWINGS

DETAILED DESCRIPTION

Parent application Ser. No. 08/183,741, filed Jan. 21, 1994, the details of which are incorporated herein by reference thereto, shows an exercise device which includes a combination treadmill and twister. As disclosed therein the twister in various embodiments includes structure which permits the twister to be detachably mounted to the treadmill so that the twister could be removed and stored to permit full use of the treadmill. The present invention is directed to the general type of combination disclosed in the parent application and more particularly to a twister which could be mounted to treadmills of various widths. It is to be understood that while the present invention will be described with the mounting of a twister to a treadmill the concepts of this invention may also be applied wherein the twister is mounted to the frame of various other types of base exercise devices such as a trampoline, a stepper or an aerobic step.

Figure 2:
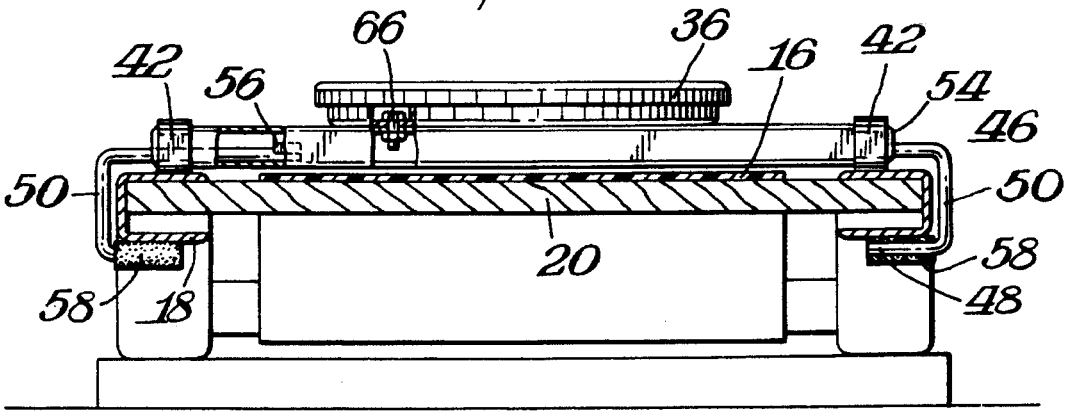
FIG. 2 is a cross-sectional view taken through FIG. 1 along the line 2—2 and showing various parts broken away.
Figure 3:
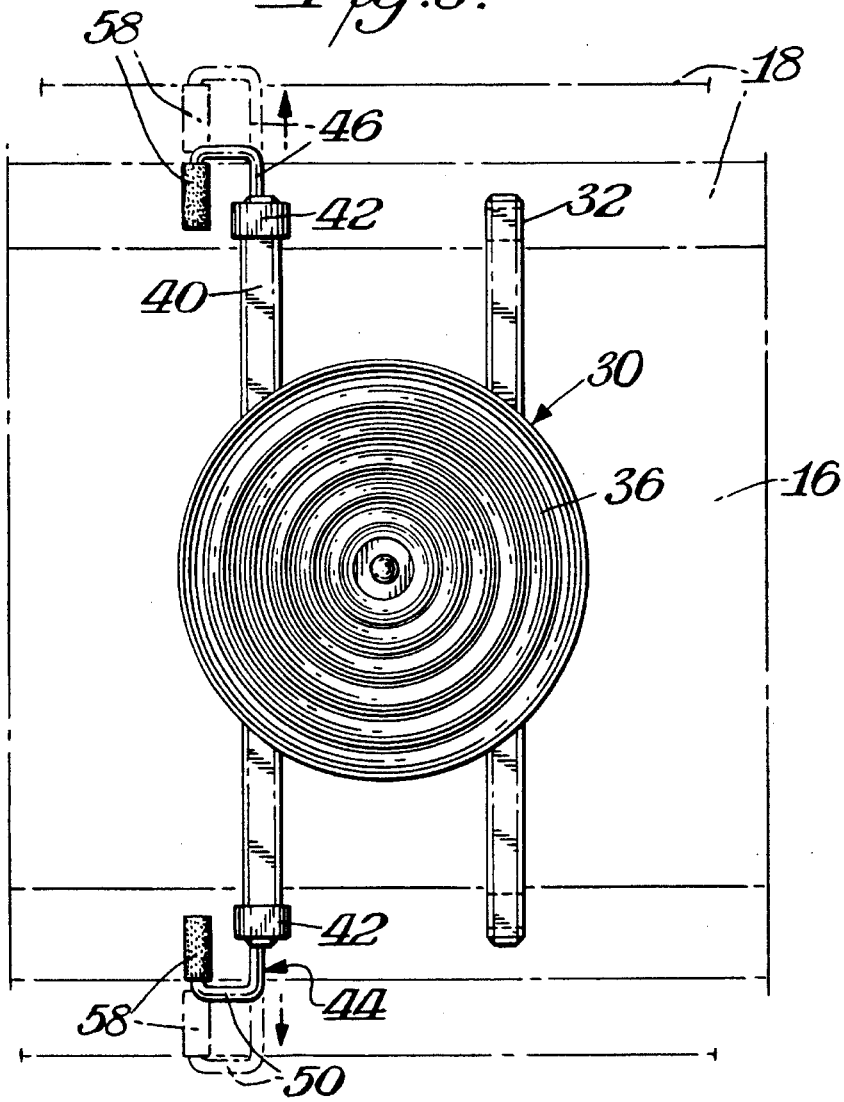
FIG. 3 is a top plan view of the embodiment shown in FIGS. 1–2.

As illustrated, the combination exercise device 10 includes a conventional treadmill 12 and a twister 14. Treadmill 12 would generally include an endless belt 16, such as shown in FIGS. 2–3, which would be mounted over rollers at each end of the treadmill with the rollers mounted in treadmill frame 18. Belt 16 could be disposed over a support 20 within the frame 18. If desired, treadmill 12 may include spaced handles 22 along its sides and bent inwardly to be connected to a center post 24 having an electronic readout unit 26 mounted thereto.

Figure 1:
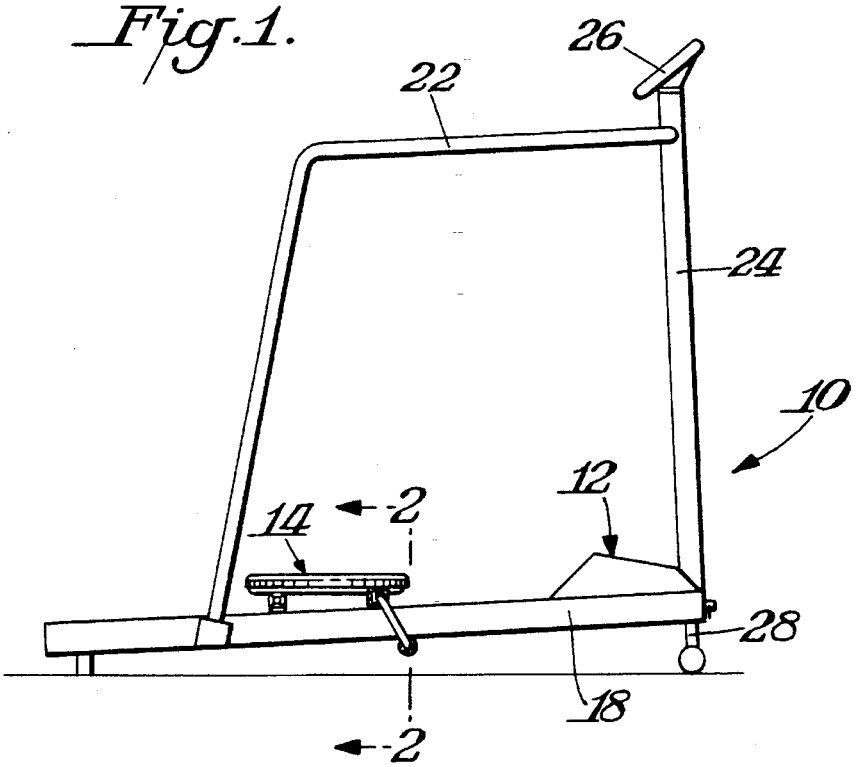
FIG. 1 is a side elevational view of a universal twister mounted on a treadmill in accordance with this invention.
Figure 4:
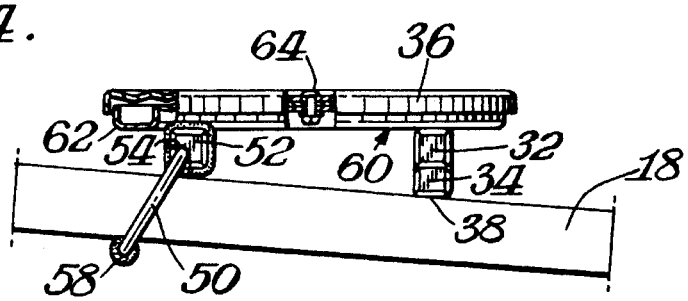
FIG. 4 is a right side elevational view partially broken away of the device shown in FIGS. 1–3.

Frequently, conventional treadmills are either inclined or provided with mechanisms to vary the inclination of belt 16 so that the user increases the workout by running or walking on a simulated hill. Thus, FIGS. 1 and 4 illustrate the frame 18 to be at a shallow inclination. Legs 28 may be provided to support the frame in this inclined condition.

If desired, treadmill 12 could include other auxiliary exercise equipment, such as resistance poles, of the type described in U.S. Pat. No. 5,207,622, the details of which are incorporated herein by reference thereto. The resistance poles could be mounted on each side of the treadmill frame or could be mounted to the center post.

Twister 14 generally includes a support assembly 30. Support assembly 30 includes a rigid support bar 32 which straddles over belt 16 and rests upon frame 18. As shown in FIG. 4 support bar 32 is provided with a foot 34 at each end for elevating the twister disc 36. The lower surface or frame contacting surface of each foot 34 may include a friction pad made of a material such as rubber having a relatively high coefficient of friction to tend to avoid any slippage of feet 34 on frame 18.

An adjusting bar or member 40 is included in support assembly 30. Bar 40 is generally parallel to support member 32 and is of generally the same length of support member 32. A collar 42 extends around each end of bar 40. Collar 42 is also preferably made of a high coefficient of friction material such as rubber so that when it contacts frame 18 there is a minimization of any tendency to slip.

An important feature of this invention is the provision of a locking member 44 at each end of adjusting bar 40. Locking member 44 is preferably of hook shape generally in the form of a C having an elongated mounting leg 46 and a free leg 48 as shown in FIG. 2. Legs 46 and 48 are interconnected by an intermediate leg 50 which is generally of a width sufficient to accommodate the thickness of frame 18. Leg 46 is telescopically mounted in hollow bar 40 as best shown in FIG. 2 to permit each locking member 44 to be inserted into or extended out from bar 40 as shown in FIG. 3. Accordingly, the telescopic movement of the locking members 44 permits the distance between the locking members to be varied in accordance with the width of a particular treadmill.

As shown in FIG. 2 each end of bar 40 is closed by a cap 52. Cap 52 has an opening 54 such as at one corner thereof as illustrated in FIG. 4 to permit leg 46 to be mounted through cap 52 and slidably moved through opening 54. The end of each leg 46 may be provided with a stop member 56 which is larger than the hole or opening 54 to thereby prevent leg 46 from being completely removed from bar 40. During assembly leg 46 may be first inserted through hole 54 and then projection or stop member 56 would be attached. The unit would then be inserted into hollow bar 40 until cap 52 seats against and closes the otherwise open end of bar 40.

As shown in the various figures a sleeve 58 is mounted on the free end of leg 48 to engage the undersurface of frame 18. Sleeve 58 is made of a material such as rubber having a high co-efficient of friction to minimize any tendency for slippage.

As shown in FIGS. 1 and 4 locking member 44 is mounted at a non-perpendicular angle to bar 40. This angle may be fixed or may be permitted to rotate within a limited range. Preferably, the angle is 45° , but may range, for example, between 40° and 50° or any other suitable angle range. By fixing or limiting the angle there is a quick hooking of the locking member around frame 18. However, by having some angular movement of the locking members it is possible for the support assembly 30 to accommodate frames of different thicknesses.

As best illustrated in FIGS. 2 and 4 a support dish 60 is secured to and across bars 32, 40. Any manner of securement may be utilized, such as welding, the support dish 60 to the bars. Preferably dish 60 is detachably mounted. Support dish 60 is generally of circular shape in its plan view and includes a ring shaped channel 62 at its periphery with the central portion 64 being relatively thin and which could be planar or as illustrated could be rippled. Channel 62 advantageously provides a location for fasteners 66 (FIG. 2) such as nuts and bolts which detachably secure each bar 32 or 40 to dish 60 at two spaced locations.

Twister disc 36 is rotatably mounted to support dish 60 by a pivot pin 68 as shown in FIG. 4. Twister disc 36 preferably has a rippled or undulated top surface 70 and a downwardly extending peripheral skirt 72 which extends below the upper edge of channel 62 of support dish 60. Although not necessary, bearing members could be provided in channel 62 and/or between the mirror undulations in plate portion 64 of dish 60 and top surface 70 of disc 36 to facilitate the rotational movement of twister disc 36 with respect to fixed support dish 60. In the illustrated embodiment when twister disc 36 rotates its pivot shaft 68 also rotates. It is to be understood that the concepts of this invention may be applied with other forms of twister structure wherein a twister disc is rotatably mounted on a support structure.

In use twister 14 would be detachably mounted to treadmill 12 by first placing support bar 32 at a lower inclination on frame 18 in a direction toward the rear of inclined treadmill 12. Mounting members 44 would be extended outwardly from bar 40 a sufficient distance so that the free legs 48 would be spaced apart a distance at least slightly greater than the distance between the outside parallel edges of frame 18. Thus legs 48 would be disposed below frame 18. Mounting members 50 would then be pushed inwardly until legs 48 are disposed below frame 18 with friction sleeves 58 in contact with the lower surfaces of frame 18.

Although the invention may be practiced with twister disc 36 in a non-horizontal position the illustrated embodiment shown in FIGS. 1 and 4 provide for the upper surface of twister disc 36 to be generally horizontal while mounted on the inclined treadmill. This is accomplished by having the distance provided by feet 34 in combination with the thickness of bar 32 to be greater than the thickness of bar 40 and its collar 42 a sufficient amount to compensate for the angle of inclination of treadmill belt 16.

Figure 5:
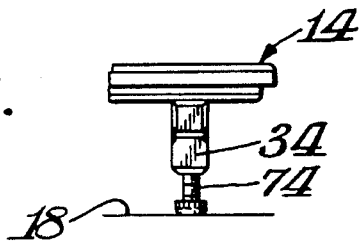
FIG. 5 is a side elevational view of a modified form of device in accordance with this invention.

FIG. 5 shows a variation of the invention which permits twister disc 36 to be horizontal when used on treadmills wherein the angle of the inclination could be varied. As shown therein each foot 34 is provided with a contact member 74 which may be moved upwardly and downwardly such as by a threaded connection with its respective foot 34. Accordingly, where the angle of inclination increases, extension 74 may be manipulated to extended a sufficient distance from foot 34 until twister disc 36 is horizontal. Conversely, where the angle of inclination is more shallow, extension 74 may be manipulated to move more closer to foot 34 a sufficient distance to position twister disc 36 horizontally.

An advantageous feature of the invention is that the mounting members 44 are sufficiently engaged with frame 18 by frictional contact without requiring the use of other fasteners or manipulations necessary to mount twister 14 to treadmill 12. If desired, however, the invention may be practiced where such additional fasteners are utilized to further assure that once twister 14 is mounted in place, it will remain in that position until it is desired to remove the twister 14 from treadmill 12.

Reference is made to parent application Ser. No. 08/183,741 with respect to other features that could be incorporated into twister 14 to permit a detachable adjustable securement, such a variation, for example, being illustrated in FIG. 15 of the parent application.

A particularly advantageous feature of twister 14 is that it could be sold as a separate unit and mounted to various sizes of treadmills or other base exercise devices without limiting the large variety of widths of such base exercise device to which twister 14 would be mounted.

What is claimed is:

1. A twister exercise device for being mounted to a base exercise device wherein the base exercise device includes a frame, said twister exercise device comprising a support assembly, said support assembly including a support rod for extending across the frame, said support assembly further including an adjusting bar disposed generally parallel to and spaced from said support bar for extending across the frame, a twister disc rotatably mounted to said support assembly, said adjusting bar having a pair of opposite ends, a locking member movably mounted to each of said opposite ends to selectively vary the distance between said locking members, and each of said locking members being of hook like shape to be hooked over the frame whereby said twister exercise device may be selectively mounted to different size frames.

2. The device of claim 1 wherein said adjusting bar is hollow, and each of said locking members including an elongated leg telescopically mounted in said adjusting bar and a free leg disposed remote from said elongated leg and being connected thereto by an intermediate leg whereby said elongated leg and said intermediate leg and said free leg may be hooked around the frame.

3. The device of claim 2 wherein each of said locking members is disposed at a non-perpendicular angle with respect to said adjusting bar.

4. The device of claim 2 including a friction sleeve mounted on said free leg for fictionally engaging a lower surface of the frame.

5. The device of claim 4 wherein each of said locking members is rotationally mounted to said adjusting bar.

6. The device of claim 5 including a foot at each end of said support bar for being disposed on the frame.

7. The device of claim 6 wherein each end of said adjusting bar is closed by a cap, and said elongated leg being telescopically inserted through a hole in said cap.

8. The device of claim 7 wherein a stop member is connected to said elongated leg within said adjusting bar to prevent said elongated leg from being completely removed from said adjusting bar.

9. The device of claim 8 wherein a collar is mounted around each of said ends of said adjusting bar, and said feet extending below said support bar by a distance greater than the thickness of said collar whereby said twister disc may be disposed in a horizontal orientation when mounted on an inclined frame.

10. The device of claim 9 wherein said support assembly includes a dish non-movably mounted across and to said support bar and said adjusting bar, said twister disc having a depending skirt, said skirt extending around said mounting dish, and said twister disc being rotationally mounted by a pivot shaft to said mounting dish.

11. The device of claim 10 in combination with a treadmill, and said frame being the frame of said treadmill.

12. The device of claim 1 including a friction sleeve mounted on said free leg for fictionally engaging a lower surface of the frame.

13. The device of claim 1 wherein each of said locking members is rotationally mounted to said adjusting bar.

14. The device of claim 1 including a foot at each end of said support bar for being disposed on the frame.

15. The device of claim 14 wherein a collar is mounted around each of said ends of said adjusting bar, and said feet extending below said support bar by a distance greater than the thickness of said collar whereby said twister disc may be disposed in a horizontal orientation when mounted on an inclined frame.

16. The device of claim 1 in combination with a treadmill, and said frame being the frame of said treadmill.

* * * * *